US012741731B2

(12) United States Patent
Tomita et al.

(10) Patent No.: US 12,741,731 B2
(45) Date of Patent: Sep. 22, 2026

(54) STEERING SYSTEM HAVING STEERING ANGLE CORRECTION FUNCTION FOR SINGLE-PROPELLER TWIN-RUDDER SHIP

(71) Applicant: JAPAN HAMWORTHY & CO., LTD., Osaka (JP)

(72) Inventors: Kazushi Tomita, Osaka (JP); Hirotaka Yamamoto, Osaka (JP)

(73) Assignee: JAPAN HAMWORTHY & CO., LTD., Osaka (JP)

( * ) Notice: Subject to any disclaimer, the term of this patent is extended or adjusted under 35 U.S.C. 154(b) by 435 days.

(21) Appl. No.: 18/555,085

(22) PCT Filed: Aug. 9, 2022

(86) PCT No.: PCT/JP2022/030370
§ 371 (c)(1),
(2) Date: Oct. 12, 2023

(87) PCT Pub. No.: WO2023/022057
PCT Pub. Date: Feb. 23, 2023

(65) Prior Publication Data

US 2024/0116619 A1 Apr. 11, 2024

(30) Foreign Application Priority Data

Aug. 19, 2021 (JP) ..... 2021-133728

(51) Int. Cl.
*B63H 25/06* (2006.01)

(52) U.S. Cl.
CPC ..... *B63H 25/06* (2013.01); *B63H 2025/066* (2013.01)

(58) Field of Classification Search
CPC .. B63H 25/06; B63H 2025/066; B63H 25/42; B63H 25/04; B63H 25/36; B63B 43/18; B63B 49/00
See application file for complete search history.

(56) References Cited

U.S. PATENT DOCUMENTS 7,016,783 B2 * 3/2006 Hac ..... B60W 30/09 303/146
2004/0163579 A1 * 8/2004 Tomita ..... B63H 25/38 114/163

(Continued)

FOREIGN PATENT DOCUMENTS

CN 110136486 A 8/2019
JP H07-052887 A 2/1995

(Continued)

OTHER PUBLICATIONS

International Search Report from corresponding International Patent Application No. PCT/JP2022/030370 dated Oct. 4, 2022.

*Primary Examiner* — Andrew Polay
(74) *Attorney, Agent, or Firm* — RENNER, OTTO, BOISSELLE & SKLAR, LLP

(57) ABSTRACT

A digital twin computation section collects a speed of an own ship, a position of the own ship, and a heading of the own ship in real time, and reproduces an actual hull motion of the own ship realized at a current steering angle on a navigational electronic marine chart. A simulation computation section displays, on the navigational electronic marine chart, an assumed hull motion of the own ship determined by calculation that assumes that a force acting on the hull is a driving force at the current steering angle. A resultant force of external forces computation section calculates an acting direction and a magnitude of a resultant force of external forces acting on the hull based on a ship speed difference, ship position difference, and heading difference between the actual hull motion and the assumed hull motion.

4 Claims, 7 Drawing Sheets

(56) References Cited

U.S. PATENT DOCUMENTS

| | | | | |
|---|---|---|---|---|
| 2016/0101838 | A1 | 4/2016 | Kojima | |
| 2021/0248912 | A1 | 8/2021 | Tomita et al. | |
| 2024/0174331 | A1* | 5/2024 | Hara | B63B 79/40 |

FOREIGN PATENT DOCUMENTS

| | | | |
|---|---|---|---|
| JP | 4055915 | B | 3/2008 |
| JP | 2014-118059 | A | 6/2014 |
| JP | 2016-080432 | A | 5/2016 |
| JP | 2016-132416 | A | 7/2016 |
| JP | 2017-052297 | A | 3/2017 |
| JP | 2020-147176 | A | 9/2020 |

* cited by examiner

STEERING SYSTEM HAVING STEERING ANGLE CORRECTION FUNCTION FOR SINGLE-PROPELLER TWIN-RUDDER SHIP

FIELD OF THE INVENTION

The present invention relates to a steering system having a steering angle correction function for a single-propeller twin-rudder ship, and pertains to technology for performing highly accurate steering when performing automatic maneuvering.

BACKGROUND OF THE INVENTION

As conventional technology for automatically maneuvering ships, for example, an automatic collision-prevention support device is described in Japanese Patent No. 4055915.

The device is installed with a radar in a ship, and includes: an other ship detector that detects, from video information acquired by the radar, the length, course, and speed of an other ship present around an own ship; a stopping performance calculator that calculates stopping performance based on the speed of the other ship relative to the own ship and the detected length of the other ship, the speed being detected by the other ship detector; a dangerous area calculator that determines, based on the calculated stopping performance and the characteristics of the navigation area of the own ship, a dangerous area where there is a danger that a collision with the other ship may occur if the own ship advances into the area; and a unit that displays the determined dangerous area on a screen.

Further, as a technique for applying a braking force to a ship, an emergency maneuvering method for a ship is described in Japanese Patent Laid-Open No. 7-52887. In this method, an emergency steering unit is activated in an emergency so as to control a rudder controller with priority over any normal steering mode to thereby apply rudder angles that cause the propeller slipstream to act to the maximum as astern propulsion to two high-lift rudders. The astern propulsion imparts to the ship an astern power which opposes an inertial force in the direction of forward movement of the ship, thereby causing the ship to come to an emergency stop or to urgently move astern. Thus, in a state where a propulsion propeller has been caused to operate forward in a single direction, astern propulsion can be immediately obtained, and stopping the ship or moving the ship astern can be performed in a short time and over a short distance with little trouble.

Autopilots (automatic steering devices) which follow an inputted course are in widespread use on large ships. An autopilot is a device that utilizes a compass to automatically navigate, and steers so as to navigate toward a course in a certain direction that was set in advance. In a case where the heading deviates from the set course due to wind or waves or the like, the autopilot automatically controls the rudder to change the ship's heading to the set azimuth and maintains the set course.

On the ocean, the probability of colliding with an obstacle decreases, and therefore automatic steering by autopilot is relatively easy. The autopilot is set so as not to steer abruptly at a large rudder angle, and since the ship is maneuvered at a small rudder angle, the autopilot is suitable for navigation on the ocean where there is plenty of time and distance for maneuvering.

However, the autopilot is a device that maintains a "course" indicated by a compass, and is not a device that maintains a route (course line). For this reason, general autopilots do not have a function that performs position correction in a case where the ship itself deviates from the course line due to wind pressure or sea currents or the like. Therefore, particularly in a case where the wind, ocean waves, or sea currents are strong from a lateral direction, it is necessary to check for deviation from the course line and check the ship's position.

Further, in congested waters and waters in which there are obstructions, it is necessary to change course with high accuracy in a short time and over a short distance, or it is necessary to manually perform steering since it is required to maintain a highly accurate course. Furthermore, when berthing, it is necessary to take into consideration the state of external forces that influence the hull such as waves and the tide, thus making automatic steering difficult.

SUMMARY OF THE INVENTION

The present invention solves the problem described above. An object of the present invention is to provide a steering system having a steering angle correction function for a single-propeller twin-rudder ship that can correct a steering angle in a manner that takes into account external forces such as wind, waves, and sea currents that act on the hull.

In order to solve the above problem, according to a steering system having a steering angle correction function for a single-propeller twin-rudder ship of the present invention, in a single-propeller twin-rudder ship including a propulsion propeller disposed at a stem of the ship, a pair of right and left high-lift rudders disposed behind the propulsion propeller, a pair of rotary vane steering gears for driving each of the high-lift rudders, respectively, a steering controller for controlling a direction of a hull motion by combining rudder angles of the two high-lift rudders, a ship speed measuring device that measures a ship speed of an own ship, a position measuring device that measures a ship position of the own ship, and an azimuth measuring device that measures a heading of the own ship; the steering controller has an electronic marine chart display section that displays a navigational electronic marine chart on a display device, a rudder angle specifying section that applies a specified rudder angle to each of the rotary vane steering gears, a course line setting section that sets a planned route of the own ship on the navigational electronic marine chart, and a maneuvering support section that calculates an appropriate steering angle that is necessary for navigation on the planned route and outputs the appropriate steering angle that is calculated as a specified rudder angle to the rudder angle specifying section; and the maneuvering support section has a digital twin computation section, a simulation computation section, a resultant force of external forces computation section, and a specified rudder angle computation section; wherein: the digital twin computation section collects in real time a ship speed of the own ship measured by the ship speed measuring device, a ship position of the own ship measured by the position measuring device, and a heading of the own ship measured by the azimuth measuring device, and reproduces, on the navigational electronic marine chart, an actual hull motion of the own ship that is realized at a current steering angle; the simulation computation section displays, on the navigational electronic marine chart, an assumed hull motion of the own ship determined by computation assuming that a force acting on the hull is a driving force at the current steering angle; the resultant force of external forces computation section calculates an acting direction and a magnitude of a resultant force of external forces acting on the hull based on a ship speed difference, a ship position difference, and a heading difference between the actual hull motion and the assumed hull motion; and the specified rudder angle computation section calculates a corrective rudder angle for resisting the resultant force of external forces, and corrects the current steering angle with the corrective rudder angle to calculate an appropriate steering angle necessary for navigating the planned route resisting the external forces.

Further, in the steering system having a steering angle correction function for a single-propeller twin-rudder ship of the present invention, the steering controller has a course correcting section that eliminates a positional deviation of the own ship with respect to a course line, wherein: the course correcting section determines, in a state in which the heading of the own ship reproduced on the navigational electronic marine chart by the digital twin computation section is in parallel with the course line, a shortest separation distance from the own ship to the course line as a positional deviation amount of the ship position of the own ship with respect to the course line, and if the shortest separation distance exceeds a set allowable range, the course correcting section outputs to the rudder angle specifying section a course correction rudder angle that is set for directing the heading to a course that intersects the course line.

Further, in the steering system having a steering angle correction function for a single-propeller twin-rudder ship of the present invention, in stop maneuvering with respect to an object on the course line, the steering controller, while keeping the propulsion propeller always rotated forward, applies rudder angles to both of the high-lift rudders to make propulsion of a propeller slipstream an astern propulsion to cause the own ship to decelerate against an inertial force in a direction of forward movement of the own ship by the astern propulsion, and controls the rudder angles applied to both of the high-lift rudders within a range from a rudder angle that causes a propeller slipstream to act at a maximum as the astern propulsion to a rudder angle that eliminates forward propulsion of the propeller slipstream; and based on the resultant force of external forces that the resultant force of external forces computation section calculates, the specified rudder angle computation section calculates an appropriate steering angle for both of the high-lift rudders which is necessary for causing the own ship to decelerate to an appropriate ship speed so as to come to a stop within a distance from the own ship to the object.

Further, in the steering system having a steering angle correction function for a single-propeller twin-rudder ship of the present invention, in collision-avoidance maneuvering for avoiding an other ship that crosses the course line, the steering controller, while keeping the propulsion propeller always rotated forward, applies rudder angles to both of the high-lift rudders to make propulsion of a propeller slipstream an astern propulsion to cause the own ship to decelerate against an inertial force in a direction of forward movement of the own ship by the astern propulsion, controls the rudder angles applied to both of the high-lift rudders within a range from a rudder angle that causes a propeller slipstream to act at a maximum as the astern propulsion to a rudder angle that eliminates forward propulsion of the propeller slipstream, and in accordance with a distance from the other ship that is an object, controls the astern propulsion which increases or decreases according to the rudder angles and secures a time required for the other ship to cross and pass through the course of the own ship; and based on the resultant force of external forces that the resultant force of external forces computation section calculates, the specified rudder angle computation section calculates an appropriate steering angle for both of the high-lift rudders which is necessary for causing the own ship to decelerate to an appropriate ship speed for avoiding the other ship within a distance from the own ship to the other ship.

According to the above configuration, the actual hull motion of the own ship that the digital twin computation section reproduces on the navigational electronic marine chart is determined based on the driving force that is applied to the hull by the current steering angle, and various external forces applied to the hull such as the resistance of the water, the wind force, and the tidal force.

Although all external forces acting on the hull cannot be measured individually, the actual hull motion of the own ship reproduced on the navigational electronic marine chart appears as the result of the influence of all the external forces acting on the hull.

On the other hand, the assumed hull motion of the own ship that the simulation computation section displays on the navigational electronic marine chart is calculated by calculating the driving force applied to the hull at the current steering angle, and calculating this driving force as the force acting on the hull.

Therefore, comparing the actual hull motion which the digital twin computation section reproduces on the navigational electronic marine chart based on the speed of the own ship, the position of the own ship, and the heading of the own ship which the digital twin computation section collects in real time with the assumed hull motion which the simulation computation section displays on the navigational electronic marine chart is equivalent to comparing the actual hull motion that is the actual result of the driving force which is controllable and the external forces which are uncontrollable acting on the hull with the assumed hull motion that is the result of a calculation that assumes that only the driving force which is controllable acts on the hull.

Hence, the acting direction and magnitude of the resultant force of all external forces acting on the hull can be ascertained based on a difference in motion that arises between the actual hull motion and the assumed hull motion without determining by calculation the individual external forces such as wind, waves, and sea currents that act on the hull.

Further, by the specified rudder angle computation section calculating a corrective rudder angle for resisting the resultant force of the external forces based on the acting direction and the magnitude of the resultant force of external forces acting on the hull that the resultant force of external forces computation section calculates, and correcting the current steering angle with the corrective rudder angle, an appropriate steering angle, that is, an appropriate steering angle required for navigation on the planned route set on the navigational electronic marine chart can be calculated.

Furthermore, if the hull shifts to outside of the course line as a result of receiving an external force, and the shortest separation distance from the own ship to the course line exceeds a set allowable range, a course correction rudder angle is applied and the heading is directed to a course that intersects the course line. Hence, the ship position automatically returns to a position on the course line.

DETAILED DESCRIPTION OF THE INVENTION

Figure 1:
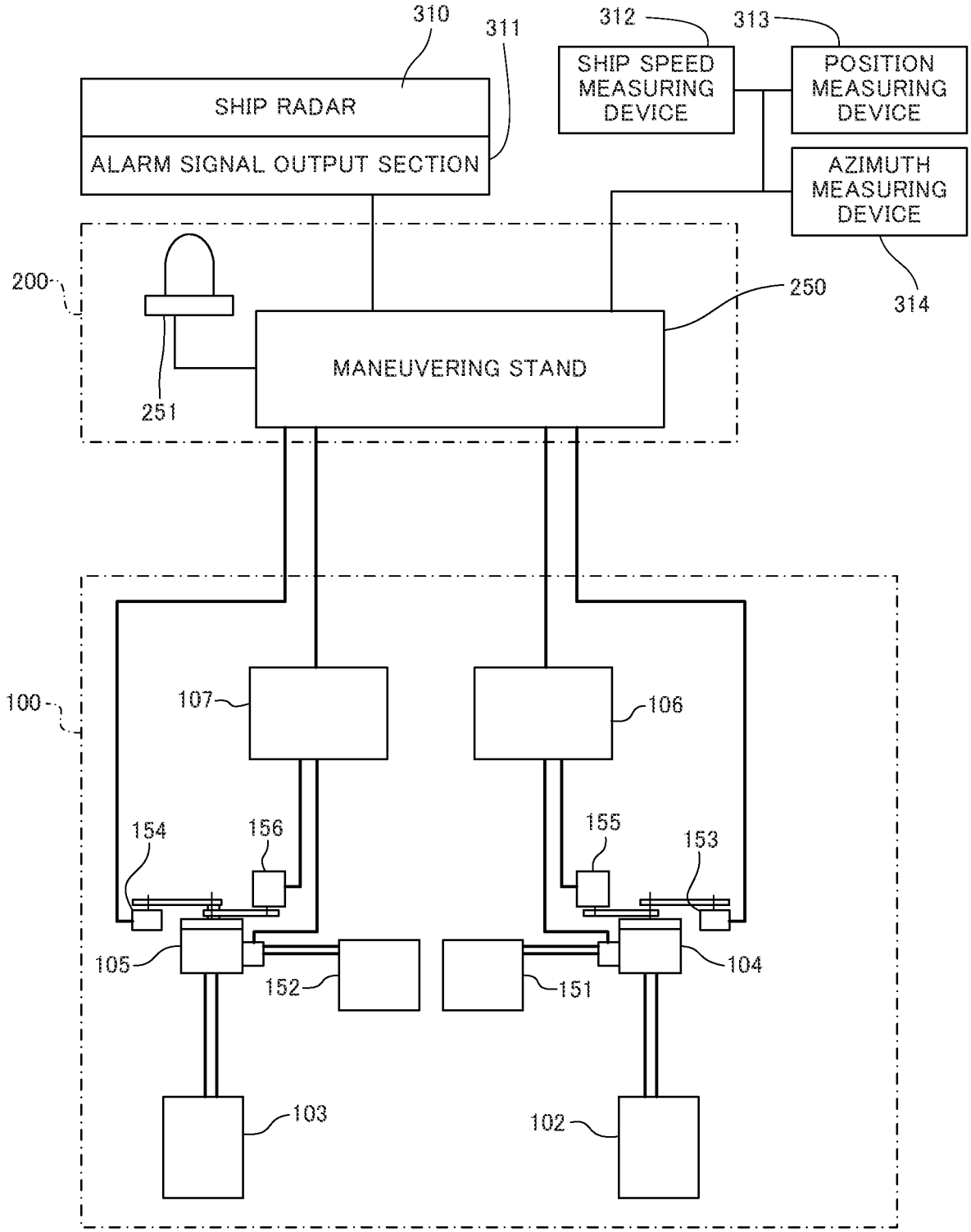
FIG. 1 is a schematic diagram illustrating a propulsion system and a steering controller for a single-propeller twin-rudder ship in an embodiment of the present invention.
Figure 2:
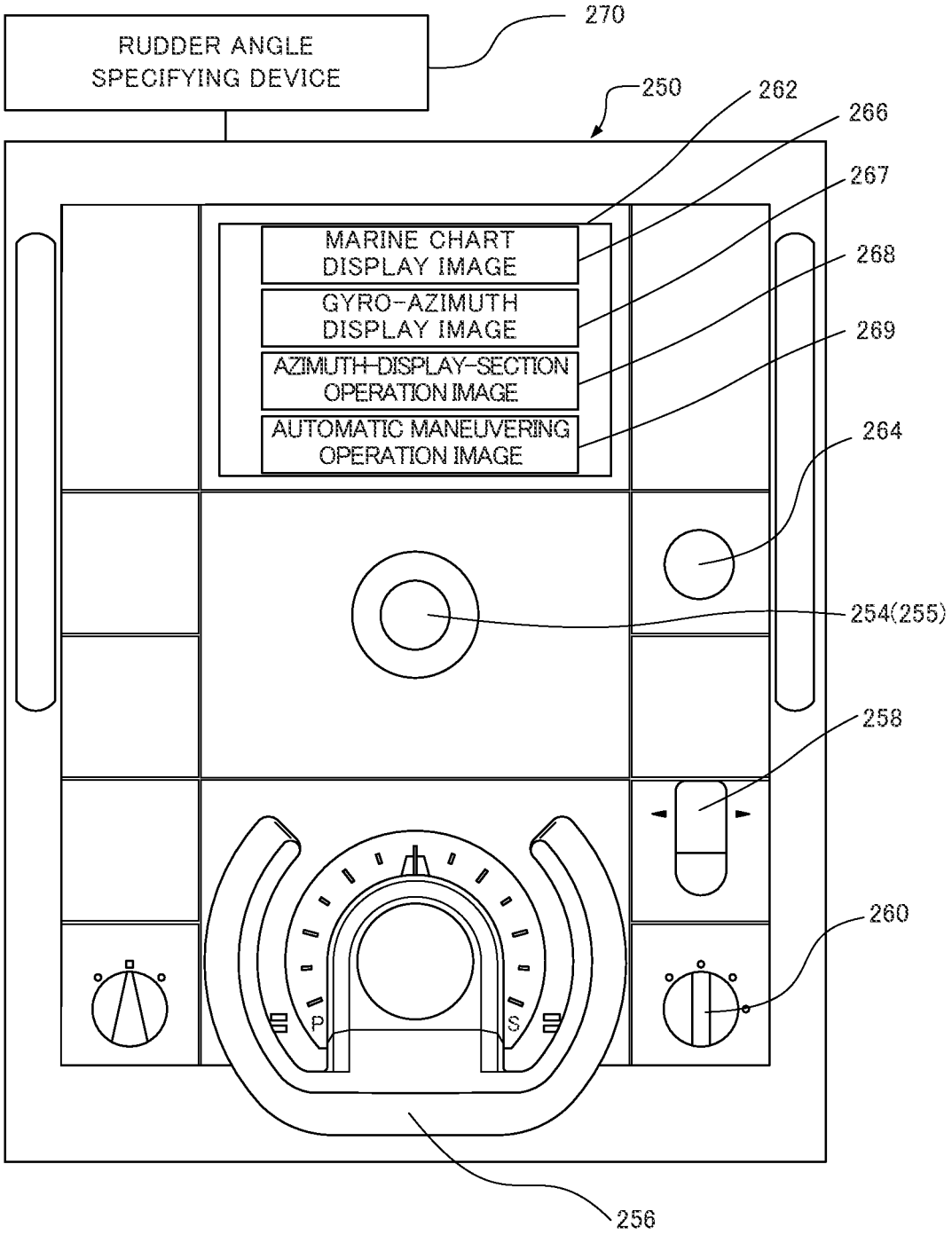
FIG. 2 is a schematic diagram illustrating a maneuvering stand of the steering controller of the single-propeller twin-rudder ship in the same embodiment.
Figure 3:
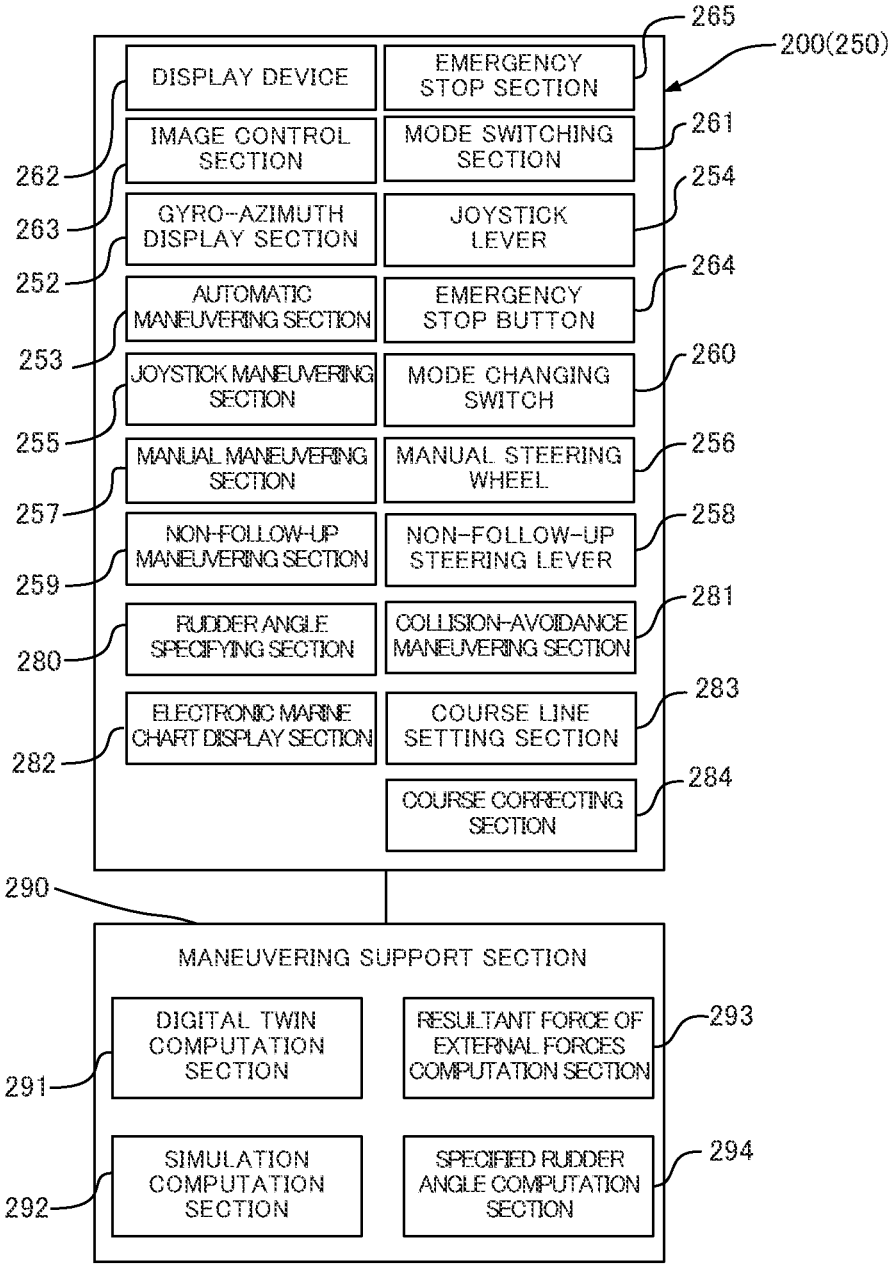
FIG. 3 is a schematic diagram illustrating the configuration of the maneuvering stand in the same embodiment.
Figure 4:
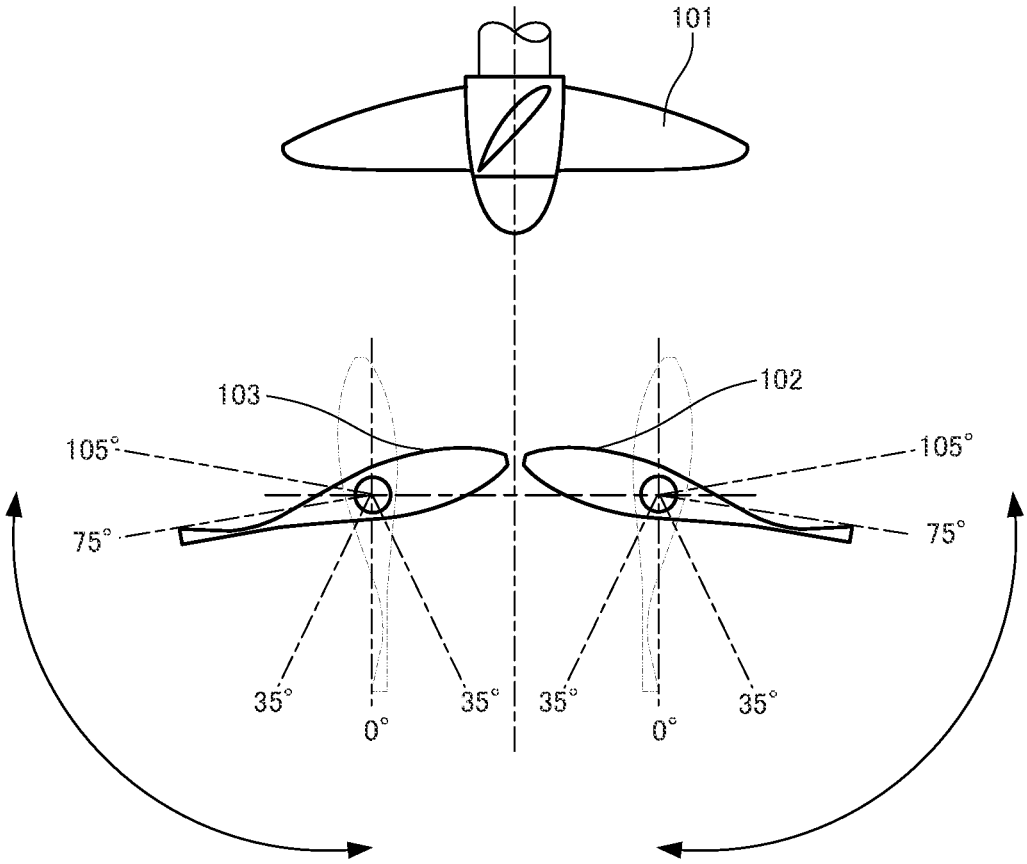
FIG. 4 is a plan view illustrating the movable ranges of high-lift rudders in the same embodiment.
Figure 5:
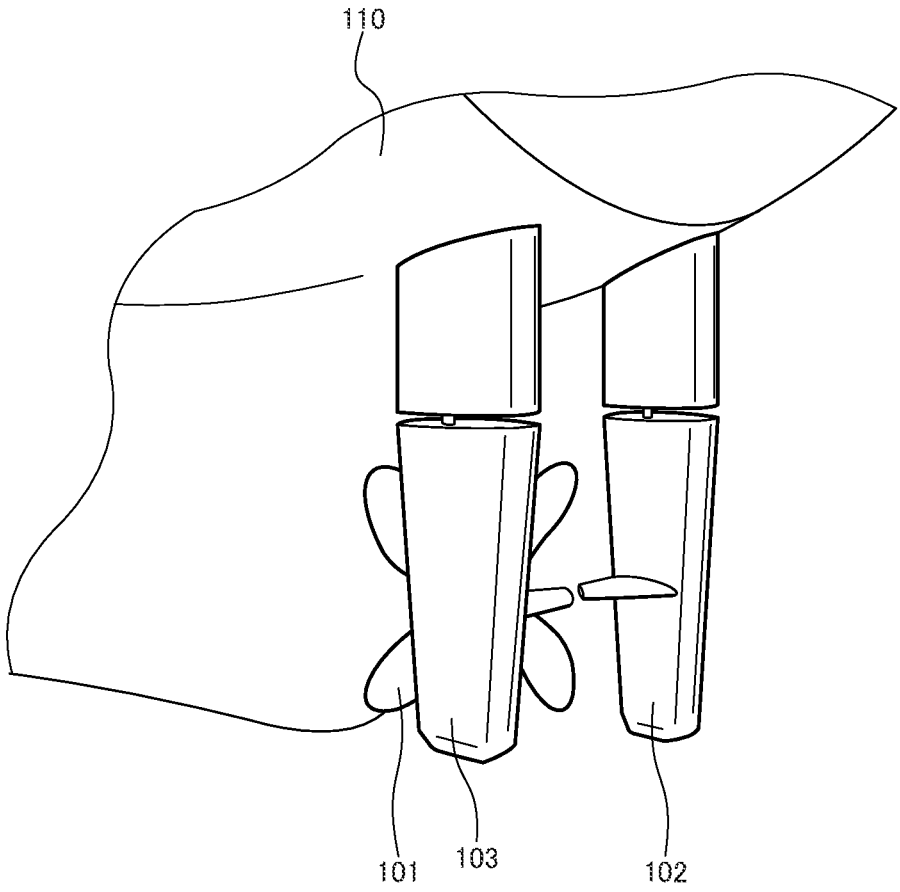
FIG. 5 is a perspective view that illustrates a propulsion device and the high-lift rudders and also illustrates the configuration of the stem section of a propulsion system 100 in the same embodiment.

An embodiment pertaining to a steering system of the present invention will be described below based on the accompanying drawings.

Configuration of Embodiment

As illustrated in FIGS. 1 to 6, a steering system having a steering angle correction function for a single-propeller twin-rudder ship according to the present embodiment includes a propulsion system 100, and a maneuvering system (steering controller) 200 for controlling the propulsion system 100.

In the propulsion system 100, a propulsion propeller 101 including a propeller of a single-engine, single-shaft type is disposed at the stem of a hull 110 and two high-lift rudders 102 and 103 are disposed behind the propeller.

The high-lift rudders 102 and 103 can each be turned outboard (to the outside) by 105° and can be turned inboard (to the inside) by 35°. The rudder angles of the two high-lift rudders 102 and 103 are independently operated at various angles while the propulsion device (propeller) of the single-engine, single-shaft type rotates in the forward direction. By changing the combination of rudder angles of the high-lift rudders 102 and 103 on both sides, the propeller slipstream can be distributed in a desired target direction so that the propulsion in each direction can be freely changed. Accordingly, the combined propulsion of the propulsion in each direction can be changed at will. Thus, by controlling the propulsion around the stem in all directions over 360° by controlling the propeller slipstream, maneuvering such as moving the ship ahead and astern, stopping, forward turning, or astern turning can be performed, and hence the movement of the ship can be freely controlled.

The propulsion system 100 further includes rotary vane steering gears 104 and 105 for driving the high-lift rudders 102 and 103, and rudder controllers (servo amplifiers) 106 and 107 for controlling the rotary vane steering gears 104 and 105.

Further, pump units 151 and 152, rudder angle transmitters 153 and 154, and feedback units 155 and 156 are connected to the rotary vane steering gears 104 and 105. The feedback units 155 and 156 are connected to the rudder controllers 106 and 107.

The maneuvering system (steering controller) 200 is stored in a maneuvering stand 250. A gyrocompass 251, a ship radar 310, a ship speed measuring device 312 that measures the speed of an own ship 501, a position measuring device 313 that measures the position of the own ship 501 by GPS or the like, and an azimuth measuring device 314 that measures the heading of the own ship 501 are connected to the maneuvering stand 250. When a collision with an other ship is predicted, the ship radar 310 transmits a collision alarm signal from an alarm signal output section 311 to the maneuvering system (steering controller) 200 of the maneuvering stand 250.

The maneuvering stand 250 integrally includes the following members in a stand cabinet: a gyro-azimuth display section 252 that displays the gyro azimuth of the gyrocompass 251; an automatic maneuvering section 253 for maneuvering in an operation mode using an autopilot that utilizes a GPS compass; a joystick maneuvering section 255 for maneuvering in an operation mode using a joystick lever 254; a manual maneuvering section 257 for maneuvering in an operation mode using a manual steering wheel 256; a non-follow-up maneuvering section 259 for maneuvering in an operation mode using a non-follow-up steering lever 258; and a mode switching section 261 that switches the maneuvering sections by means of a mode changing switch 260.

The maneuvering stand 250 further includes: a display device 262 that includes a touch panel on a screen; an image control section 263 that controls an image shown on the display device 262; an emergency stop section 265 that stops the ship in an operation mode for urgently stopping the ship with priority over all of the operation modes when an emergency stop button 264 is pressed; a rudder angle specifying section 280 that applies specified rudder angles to the rotary vane steering gears 104 and 105 through the rudder controllers 106 and 107; a collision-avoidance maneuvering section 281 for maneuvering in an operation mode for collision-avoidance maneuvering that is performed by the own ship that navigates while viewing an other ship on a starboard side when there is a risk that two ships crossing each other on a course during navigation in congested waters may collide with each other; an electronic marine chart display section 282 that displays a navigational electronic marine chart on the display device 262; a course line setting section 283 that sets a planned route of the own ship on a navigational electronic marine chart; a course correcting section 284 that eliminates a positional deviation of the own ship with respect to a course line; and a maneuvering support section 290 that calculates an appropriate steering angle that is necessary for navigation on the planned route, and outputs the calculated appropriate steering angle as a specified rudder angle to the rudder angle specifying section 280.

The image control section 263 selectively or simultaneously displays a marine chart display image 266 showing a navigational electronic marine chart, a gyro-azimuth display image 267 indicating a gyro azimuth, an azimuth-display-section operation image 268 for performing a touch operation with respect to the gyro-azimuth display section 252 on a monitor screen, and an automatic maneuvering operation image 269 for performing a touch operation with respect to the automatic maneuvering section 253 on the monitor screen.

The joystick maneuvering section 255 is configured so that the joystick lever 254 can be operated in both X and Y directions. A command motion direction of the hull is controlled by the tilt direction of the joystick lever 254, and a fore-and-aft direction command speed and a hull-lateral-direction command speed are controlled by the tilt angle in the tilt direction.

The joystick maneuvering section 255 controls the respective rudder angles of the high-lift rudders 102 and 103 on both sides to a rudder angle that is set according to the tilt direction of the joystick lever 254. The rudder angles of the high-lift rudders 102 and 103 on both sides are combined to turn the propulsion of a propeller slipstream to a target direction. The respective rudder angles of the high-lift rudders 102 and 103 on both sides are controlled within a range of up to 105° on the outside and up to 35° on the inside by the rotary vane steering gears 104 and 105.

Figure 6:
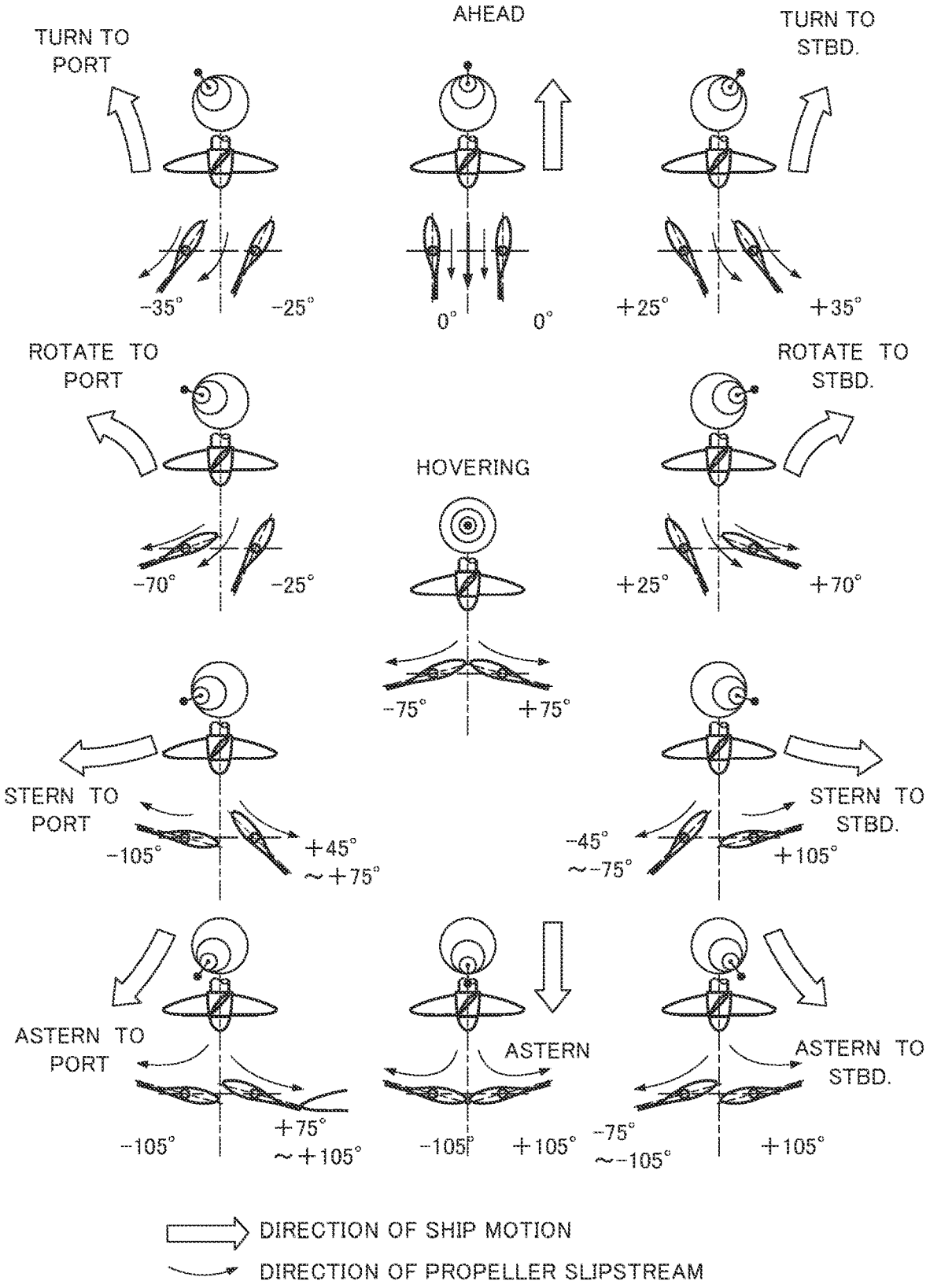
FIG. 6 is a schematic diagram illustrating combined rudder angles and turning directions of the rudders.

Referring to FIG. 6, combinations of basic rudder angles of the high-lift rudders 102 and 103, the states of the joystick lever 254, the designations of the combinations and the states, and the directions of propeller slipstream lines and motions will be described below.

In FIG. 6, the rudders are illustrated in horizontal cross section and the rudder angles of the rudders are indicated beside or below the rudders. The rudder angles of right courses are indicated as positive (+) angles and the rudder angles of left courses are indicated as negative (−) angles. The designations of the combinations of the rudder angles are indicated. The propeller slipstreams are indicated by thin arrow lines and the propulsive directions of the ship moved by the slipstreams are indicated by thick and blank arrow lines.

Specifically, "turn to point" indicates the port rudder at −35° and the starboard rudder at −25°, "rotate to port" indicates the port rudder at −70° and the starboard rudder at −25°, "stem to port" indicates the port rudder at −105° and the starboard rudder at +45° to +75°, "astern to port" indicates the port rudder at −105° and the starboard rudder at +75° to +105°, "ahead" indicates the port rudder at 0° and the starboard rudder at 0°, "hovering" indicates the port rudder at −75° and the starboard rudder at +75°, "astern" indicates the port rudder at −105° and the starboard rudder at +105°, "turn to stbd." indicates the port rudder at +25° and the starboard rudder at +35°, "rotate to stbd." indicates the port rudder at +25° and the starboard rudder at +70°, "stem to stbd." indicates the port rudder at −45° to −75° and the starboard rudder at +105°, and "astern to stbd." indicates the port rudder at −75° to −105° and the starboard rudder at +105°.

The single-propeller twin-rudder ship including the two high-lift rudders 102 and 103 can freely change and output the direction and magnitude of propulsion in all the directions of the ship by changing the combined rudder angles of the high-lift rudders 102 and 103.

The automatic maneuvering section 253 guides and controls the own ship to a predetermined course based on a GPS compass, current position information on the own ship based on an electronic marine chart system, guidance route information, and stopped-ship holding position information.

When the emergency stop button 264 is pressed in an emergency, the emergency stop section 265 cancels the rudder angles of current maneuvering in any maneuvering state indicated by the joystick lever 254 or in maneuvering in any other operation modes. The emergency stop section 265 then turns the port rudder 103 to port (clockwise in top view) and the starboard rudder 102 to starboard (counterclockwise in top view) to hardover (full), so that the ship is stopped by an applied braking force.

The manual maneuvering section 257 is provided for maneuvering the ship while controlling the rudder angles of the two high-lift rudders 102 and 103 by rotating the manual steering wheel 256.

The non-follow-up maneuvering section 259 turns the ship to starboard or port according to a time period for which the non-follow-up steering lever 258 is laterally operated.

The collision-avoidance maneuvering section 281 performs collision-avoidance maneuvering by automatically controlling a propulsive direction or a ship speed according to a current situation based on position information pertaining to the own ship 501 and one or more other ships 401 and 402, the position information being obtained from the gyrocompass 251 and the ship radar 310, azimuth information pertaining to the own ship 501 and the other ships 401 and 402, distance information indicating distances to the other ships 401 and 402, and relative speed information with respect to the other ships 401 and 402.

The course correcting section 284 determines, in a state in which the heading of the own ship reproduced on the navigational electronic marine chart by a digital twin computation section 291 is in parallel with the course line, a shortest separation distance from the own ship to the course line as a positional deviation amount of the position of the own ship with respect to the course line. If the shortest separation distance exceeds a set allowable range, the course correcting section 284 outputs a course correction rudder angle that is set for directing the heading to a course that intersects the course line to the rudder angle specifying section 280.

The maneuvering support section 290 has the digital twin computation section 291, a simulation computation section 292, a resultant force of external forces computation section 293, and a specified rudder angle computation section 294.

The digital twin computation section 291 collects in real time the speed of the own ship measured by the ship speed measuring device 312, the position of the own ship measured by the position measuring device 313, and the heading of the own ship measured by the azimuth measuring device 314, and reproduces the actual hull motion of the own ship that is realized at the current steering angle on the navigational electronic marine chart.

The simulation computation section 292 displays, on the navigational electronic marine chart, an assumed hull motion of the own ship assumed by a calculation at the current steering angle.

The resultant force of external forces computation section 293 calculates an acting direction and a magnitude of a resultant force of external forces acting on the hull based on a ship speed difference, a ship position difference, and a heading difference between the actual hull motion and the assumed hull motion.

The specified rudder angle computation section 294 calculates a corrective rudder angle for resisting the resultant force of external forces. The specified rudder angle computation section 294 corrects the current steering angle with the corrective rudder angle and calculates an appropriate steering angle necessary for navigating the planned route resisting the external forces.

Hereunder, operations performed in the above configuration are described.

1. Operation Mode Using Joystick

The mode changing switch 260 is operated to select an operation mode in which operation is performed using the joystick. The joystick maneuvering section 255 issues commands for the command motion direction of the hull, fore-and-aft direction command propulsion, and lateral command propulsion of the hull by use of the joystick lever 254.

In this maneuvering, the propulsion propeller 101 is rotated forward and the high-lift rudders 102 and 103 are independently operated at various angles so as to control the propeller slipstream, thereby controlling propulsion around the stem in all directions over 360°. Under this control, the ship can be maneuvered forward and backward, stopped, turned forward, and turned backward, thereby improving maneuverability.

In other words, by changing the combinations of the rudder angles of the rudders on both sides, a propeller slipstream can be turned in a desired target direction so as to change the propulsion to the relevant direction. The combinations of rudder angles in the present embodiment are merely exemplary and can be optionally changed to obtain a target propulsion direction and propulsion.

As has been discussed, the operation mode using the joystick does not require a reversal of the propulsion of the propulsion device (a backward rotation of the propeller), achieving any maneuvering control with the main engine always rotated forward. That is, without increasing or reducing the number of revolutions of the main engine, the rudder angles of both rudders are adjusted so as to minutely control the speed of the ship in a continuous manner from a maximum ahead speed to a maximum astern speed according to the number of revolutions of the propeller at that time.

2. Operation Mode Using Emergency Stop Section

An action to press the emergency stop button 264 starts the emergency stop section 265, thereby enabling the ship to be stopped urgently with priority over all the operation modes. Specifically, regardless of the steering mode of the joystick lever 254 or other operation modes, the emergency stop section 265 switches the mode to a crash astern mode ("ASTERN" in which the port rudder is set to 105° aport and the starboard rudder is set to 105° astarboard). Since the rudders generate a very large braking force and astern propulsion, the hull can be stopped in a much shorter time over a much shorter distance than in maneuvering with a backward rotation of the propeller.

Further, in the crash astern mode, it is not necessary to stop the main engine and restart reversing. Thus, the ship is not brought into an uncontrolled state, thereby enabling a quick response to situations during navigation.

If the ship is turned due to the characteristics of the ship or disturbance during maneuvering by the emergency stop section 265 or if the moving direction, for example, the heading is to be changed as required, an operation of the joystick lever 254 enables collision avoidance while freely maneuvering the ship with the joystick lever 254 similarly to when performing ordinary joystick operation.

3. Operation Mode by Use of Autopilot

In normal navigation, the mode changing switch 260 is operated to select an autopilot operation mode.

The automatic maneuvering operation image 269 is displayed on the monitor screen of the display device 262, the position of the own ship, a target azimuth, a destination position, or a fore-and-aft line azimuth is inputted to the automatic maneuvering section 253 by touching the monitor screen, and the own ship is maneuvered according to a set course by automatic guidance.

In addition, a navigational electronic marine chart as the marine chart display image 266 is displayed on a monitor screen of the display device 262 by the electronic marine chart display section 282. The planned route of the own ship is set on the navigational electronic marine chart by the course line setting section 283.

The automatic maneuvering section 253 appropriately controls the rudder angles based on the current position information of the own ship, guidance route information, and stopped-ship holding position information. The autopilot maintains a course indicated by the gyrocompass as a target azimuth or a fore-and-aft line azimuth set on the automatic maneuvering operation image 269.

However, the position of the own ship is not maintained on the course line, and therefore the ship position sometimes deviates from the course line due to wind pressure and sea currents or the like while maintaining a state in which the heading is in parallel with the course line on the navigational electronic marine chart.

In a state in which the heading of the own ship reproduced on the navigational electronic marine chart by the digital twin computation section is in parallel with the course line on the navigational electronic marine chart by maneuvering performed by the autopilot, the course correcting section 284 determines a shortest separation distance from the own ship to the course line as a positional deviation amount of the position of the own ship with respect to the course line.

If the shortest separation distance exceeds a set allowable range, the course correcting section 284 temporarily stops maneuvering by the autopilot, and outputs a course correction rudder angle that is set for directing the heading to a course that intersects the course line to the rudder angle specifying section 280.

The rudder angle specifying section 280 applies a course correction rudder angle to the rotary vane steering gears 104 and 105 through the rudder controllers 106 and 107, and when the ship position arrives at the course line, the course correcting section 284 returns to maneuvering by the autopilot.

The maneuvering support section 290 collects in real time, by means of the digital twin computation section 291, the speed of the own ship measured by the ship speed measuring device 312, the position of the own ship measured by the position measuring device 313, and the heading of the own ship measured by the azimuth measuring device 314, and reproduces the actual hull motion of the own ship that is realized at the current steering angle on the navigational electronic marine chart displayed on a monitor screen of the display device 262.

The actual hull motion of the own ship that the digital twin computation section 291 reproduces on the navigational electronic marine chart is determined based on the driving force that is applied to the hull by the current steering angle, and various external forces applied to the hull such as the resistance of the water, the wind force, and the tidal force.

Although all external forces acting on the hull cannot be measured individually, the actual hull motion of the own ship reproduced on the navigational electronic marine chart appears as the result of the influence of all the external forces acting on the hull.

The simulation computation section 292 displays, on the navigational electronic marine chart, an assumed hull motion of the own ship which is assumed by a calculation at the current steering angle.

The assumed hull motion of the own ship that the simulation computation section 292 displays on the navigational electronic marine chart is calculated by calculating a driving force applied to the hull at the current steering angle, that is, a force generated by a combination of the propulsion of the propulsion propeller 101 and the rudder angles of the high-lift rudders 102 and 103, and calculating this driving force as the force acting on the hull. The calculation by the simulation computation section 292 in this case does not take into account any external forces. However, although it is possible to incorporate individual measurable external forces into the calculation by the simulation computation section 292, it is complicated to incorporate individual external forces into the calculation by the simulation computation section 292 and there are also external forces that cannot be measured. Hence it is not possible to incorporate all external forces into the calculation by the simulation computation section 292.

Therefore, comparing the actual hull motion which the digital twin computation section 291 reproduces on the navigational electronic marine chart based on the speed of the own ship, the position of the own ship, and the heading of the own ship that are collected in real time with the assumed hull motion which the simulation computation section 292 displays on the navigational electronic marine chart is equivalent to comparing the actual hull motion that is the actual result of the driving force which is controllable and the external forces which are uncontrollable acting on the hull with the assumed hull motion that is the result of a calculation that assumes that only the driving force which is controllable acts on the hull.

Hence, the acting direction and magnitude of the resultant force of all external forces acting on the hull can be ascertained based on a difference in motion that arises between the actual hull motion and the assumed hull motion without determining by calculation the individual external forces such as wind, waves, and sea currents that act on the hull.

The resultant force of external forces computation section 293 calculates the acting direction and the magnitude of the resultant force of external forces acting on the hull based on a ship speed difference, a ship position difference, and a heading difference between the actual hull motion and the assumed hull motion. Based on the acting direction and the magnitude of the resultant force of external forces, the specified rudder angle computation section 294 calculates a corrective rudder angle for resisting the resultant force of the external forces, and corrects the current steering angle with the corrective rudder angle to thereby calculate an appropriate steering angle, that is, a steering angle that is required for navigation on the planned route set on the navigational electronic marine chart. The maneuvering support section 290 outputs the appropriate steering angle that is calculated to the rudder angle specifying section 280 as a specified rudder angle.

When performing stop maneuvering with respect to an object present on the course line, while keeping the propulsion propeller 101 always rotated forward, the automatic maneuvering section 253 applies rudder angles to both of the high-lift rudders 102 and 103 to make the propulsion of the propeller slipstream an astern propulsion to cause the own ship 501 to decelerate against an inertial force in a direction of forward movement of the own ship 501 by the astern propulsion, and controls the rudder angles applied to both of the high-lift rudders 102 and 103 within a range from a rudder angle that causes the propeller slipstream to act at a maximum as the astern propulsion to a rudder angle that eliminates forward propulsion of the propeller slipstream.

In this stop maneuvering also, taking into consideration the influence of external forces, the specified rudder angle computation section 294 calculates an appropriate steering angle for both of the high-lift rudders 102 and 103 that is necessary for causing the own ship 501 to decelerate to an appropriate ship speed so as to come to a stop within a distance from the own ship 501 to the object based on the resultant force of external forces which the resultant force of external forces computation section 293 calculates.

4. Manual Operation Mode

The mode changing switch 260 is operated to select an operation mode in which operation is performed using the manual steering wheel 256. In this operation mode, the manual steering wheel 256 is rotated to specify rudder angles for the two high-lift rudders 102 and 103 to the manual maneuvering section 257, and the rudder angles of the two high-lift rudders 102 and 103 are controlled to maneuver the ship.

5. Non-Follow-Up Operation Mode

The mode changing switch 260 is operated to select an operation mode in which operation is performed using the non-follow-up steering lever 258. In this operation mode, the non-follow-up maneuvering section 259 turns the ship to starboard or port according to a time period for which the non-follow-up steering lever 258 is laterally operated.

6. Collision-Avoidance Maneuvering Mode

In the case of navigating through congested waters, the mode changing switch 260 is operated to select an operation mode in which operation is performed by the collision-avoidance maneuvering section 281.

In the collision-avoidance maneuvering mode for navigation in congested waters, the collision-avoidance maneuvering section 281 performs collision-avoidance maneuvering when the ship radar 310 transmits the collision alarm signal when there is a risk that other ships 401 and 402 crossing a course line 502 of the own ship 501 may collide with the own ship 501.

Figure 7:
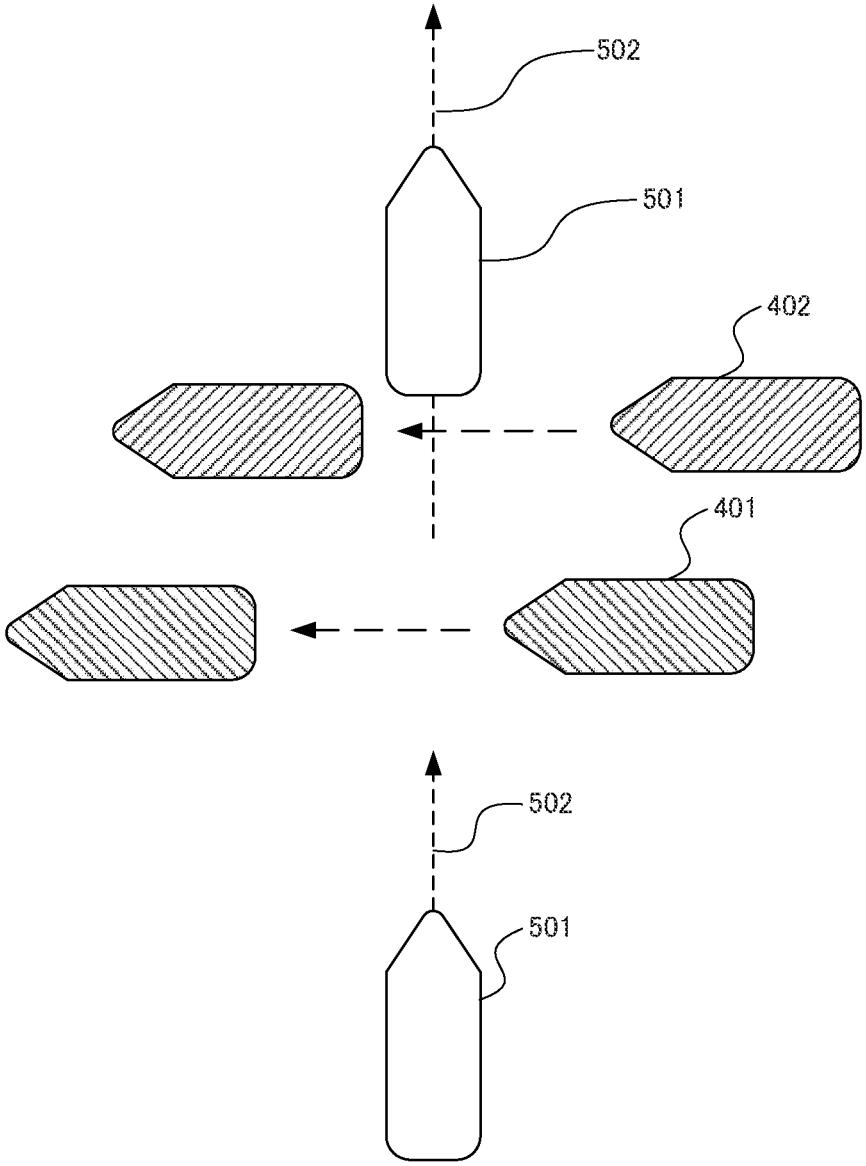
FIG. 7 is a schematic diagram illustrating collision-avoidance maneuvering in the same embodiment.

As illustrated in FIG. 7, in the collision-avoidance maneuvering mode for navigation in congested waters, in response to the collision alarm signal transmitted from the ship radar 310 when there is a risk that the other ships 401 and 402 crossing the course line 502 of the own ship 501 on the navigational electronic marine chart may collide with the own ship 501, the collision-avoidance maneuvering section 281 performs collision-avoidance maneuvering in which, while keeping the propulsion propeller 101 always rotated forward and continuing to navigate the own ship 501 on the current course line 502 while viewing the other ships 401 and 402 on the starboard side, the collision-avoidance maneuvering section 281 applies rudder angles to both of the high-lift rudders 102 and 103 to make propulsion of the propeller slipstream an astern propulsion. The own ship 501 is caused to decelerate against an inertial force in the direction of forward movement of the own ship 501 by the astern propulsion, thereby avoiding a collision with the other ships 401 and 402.

The rudder angles which the collision-avoidance maneuvering section 281 applies to both of the high-lift rudders 102 and 103 are within a range from a rudder angle that causes the propeller slipstream to act at a maximum as the astern propulsion to a rudder angle that eliminates forward propulsion of the propeller slipstream. Further, while the propulsion propeller 101 keeps a constant forward rotation, the astern propulsion which increases or decreases according to the rudder angles is controlled in accordance with a distance from the other ships 401 and 402, to thereby decelerate the ship to a speed that can secure a time period required for the other ships 401 and 402 to cross and pass through the course line 502 of the own ship 501.

In this collision-avoidance maneuvering also, taking into consideration the influence of external forces, the specified rudder angle computation section 294 calculates an appropriate steering angle for both of the high-lift rudders 102 and 103 that is necessary for causing the own ship 501 to decelerate to an appropriate ship speed for avoiding the other ships 401 and 402 within a distance from the own ship 501 to the other ships 401 and 402 based on the resultant force of external forces which the resultant force of external forces computation section 293 calculates.

Subsequently, after the other ships 401 and 402 have crossed and passed through the course line 502 of the own ship 501, the rudder angles of both of the high-lift rudders 102 and 103 are controlled so as to continuously navigate the own ship 501 on the course line 502 by using the propulsion of a propeller slipstream as forward propulsion.

What is claimed is:

1. A steering system having a steering angle correction function for a single-propeller twin-rudder ship, wherein:

in a single-propeller twin-rudder ship comprising a propulsion propeller disposed at a stern of the ship, a pair of right and left high-lift rudders disposed behind the propulsion propeller, a pair of rotary vane steering gears for driving each of the high-lift rudders, respectively, a steering controller for controlling a direction of a hull motion by combining rudder angles of the two high-lift rudders, a ship speed measuring device that measures a ship speed of an own ship, a position measuring device that measures a ship position of the own ship, and an azimuth measuring device that measures a heading of the own ship, the steering controller has an electronic marine chart display section that displays a navigational electronic marine chart on a display device, a rudder angle specifying section that applies a specified rudder angle to each of the rotary vane steering gears, a course line setting section that sets a planned route of the own ship on the navigational electronic marine chart, and a maneuvering support section that calculates an appropriate steering angle that is necessary for navigation on the planned route and outputs the appropriate steering angle that is calculated as a specified rudder angle to the rudder angle specifying section, and the maneuvering support section has a digital twin computation section, a simulation computation section, a resultant force of external forces computation section, and a specified rudder angle computation section, wherein:

the digital twin computation section collects in real time a ship speed of the own ship measured by the ship speed measuring device, a ship position of the own ship measured by the position measuring device, and a heading of the own ship measured by the azimuth measuring device, and reproduces, on the navigational electronic marine chart, an actual hull motion of the own ship that is realized at a current steering angle;

the simulation computation section displays, on the navigational electronic marine chart, an assumed hull motion of the own ship determined by computation assuming that a force acting on the hull is a driving force at the current steering angle;

the resultant force of external forces computation section calculates an acting direction and a magnitude of a resultant force of external forces acting on the hull based on a ship speed difference, a ship position difference, and a heading difference between the actual hull motion and the assumed hull motion; and the specified rudder angle computation section calculates a corrective rudder angle for resisting the resultant force of external forces, and corrects the current steering angle with the corrective rudder angle to calculate an appropriate steering angle necessary for navigating the planned route resisting the external forces.

2. The steering system having a steering angle correction function for a single-propeller twin-rudder ship according to claim 1, the steering controller having a course correcting section that eliminates a positional deviation of the own ship with respect to a course line, wherein:

the course correcting section determines, in a state in which the heading of the own ship reproduced on the navigational electronic marine chart by the digital twin computation section is in parallel with the course line, a shortest separation distance from the own ship to the course line as a positional deviation amount of the ship position of the own ship with respect to the course line, and if the shortest separation distance exceeds a set allowable range, the course correcting section outputs to the rudder angle specifying section a course correction rudder angle that is set for directing the heading to a course that intersects the course line.

3. The steering system having a steering angle correction function for a single-propeller twin-rudder ship according to claim 1, wherein in stop maneuvering with respect to an object on the course line, the steering controller:

while keeping the propulsion propeller always rotated forward, applies rudder angles to both of the high-lift rudders to make propulsion of a propeller slipstream an astern propulsion to cause the own ship to decelerate against an inertial force in a direction of forward movement of the own ship by the astern propulsion, and controls the rudder angles applied to both of the high-lift rudders within a range from a rudder angle that causes a propeller slipstream to act at a maximum as the astern propulsion to a rudder angle that eliminates forward propulsion of the propeller slipstream; and based on the resultant force of external forces that the resultant force of external forces computation section calculates, the specified rudder angle computation section calculates an appropriate steering angle for both of the high-lift rudders which is necessary for causing the own ship to decelerate to an appropriate ship speed so as to come to a stop within a distance from the own ship to the object.

4. The steering system having a steering angle correction function for a single-propeller twin-rudder ship according to claim 1, wherein in collision-avoidance maneuvering for avoiding an other ship that crosses the course line, the steering controller:

while keeping the propulsion propeller always rotated forward, applies rudder angles to both of the high-lift rudders to make propulsion of a propeller slipstream an astern propulsion to cause the own ship to decelerate against an inertial force in a direction of forward movement of the own ship by the astern propulsion, controls the rudder angles applied to both of the high-lift rudders within a range from a rudder angle that causes a propeller slipstream to act at a maximum as the astern propulsion to a rudder angle that eliminates forward propulsion of the propeller slipstream, and in accordance with a distance from the other ship that is an object, controls the astern propulsion which increases or decreases according to the rudder angles and secures a time required for the other ship to cross and pass through the course of the own ship: and based on the resultant force of external forces that the resultant force of external forces computation section calculates, the specified rudder angle computation section calculates appropriate steering angles for both of the high-lift rudders which is necessary for causing the own ship to decelerate to an appropriate ship speed for avoiding the other ship within a distance from the own ship to the other ship.

* * * * *